US005749392A

United States Patent [19]

Glotin

[11] Patent Number: 5,749,392

[45] Date of Patent: May 12, 1998

[54] PUMP CONNECTOR DEVICE

[75] Inventor: Joël Glotin, Yerres, France

[73] Assignee: Zefal, Aubervilliers, France

[21] Appl. No.: 753,728

[22] Filed: Nov. 29, 1996

[30] Foreign Application Priority Data

Nov. 28, 1995 [FR] France ..... 95 14081

[51] Int. Cl.[6] ..... F16K 15/20

[52] U.S. Cl. ..... 137/231; 137/223; 285/12

[58] Field of Search ..... 137/223, 231; 285/12, 311

[56] References Cited

U.S. PATENT DOCUMENTS

| | | | |
|---|---|---|---|
| 1,854,797 | 4/1932 | Kirkpatrick | 137/231 |
| 2,778,388 | 1/1957 | Harrison | 137/231 |
| 3,142,328 | 7/1964 | Iknayan et al. | 137/231 |
| 3,498,321 | 3/1970 | Barrett et al. | 137/223 |
| 3,926,205 | 12/1975 | Gourlet | 137/223 |
| 4,193,429 | 3/1980 | Devienne et al. | 137/223 |
| 4,765,358 | 8/1988 | Cady | 137/223 |
| 4,932,849 | 6/1990 | Scheffer | 417/568 |
| 5,379,796 | 1/1995 | Wang | 137/231 |
| 5,638,865 | 6/1997 | Wu | 137/223 |
| 5,645,100 | 7/1997 | Chuang et al. | 137/223 |
| 5,666,990 | 9/1997 | Wu | 137/223 |
| 5,683,234 | 11/1997 | Chuang et al. | 137/223 |

FOREIGN PATENT DOCUMENTS

| | | | |
|---|---|---|---|
| 983471 | 4/1902 | France . | |
| 544366 | 9/1922 | France . | |
| 380975 | 9/1923 | Germany . | |
| 38 19 771 | 7/1989 | Germany | 417/568 |

*Primary Examiner*—Denise L. Ferensic
*Assistant Examiner*—Joanne Y. Kim
*Attorney, Agent, or Firm*—Young & Thompson

[57] ABSTRACT

A pump connector device for inflating different pneumatic tires including different type valves includes a mobile member containing at least two different connectors. The mobile member is movable in a housing so that one or other of the connectors can be used.

9 Claims, 2 Drawing Sheets

FIG. 1
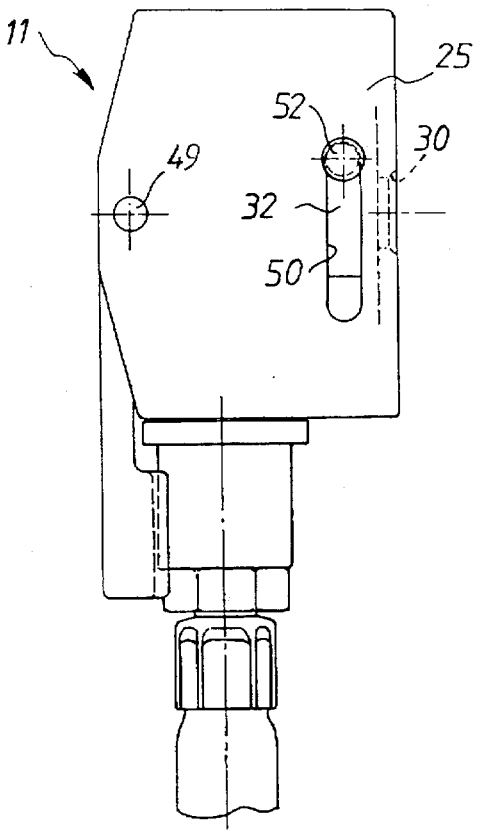
FIG. 2
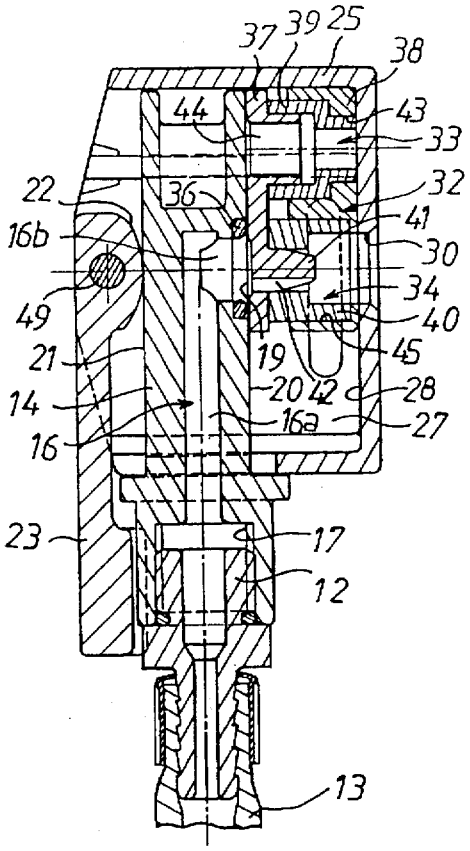
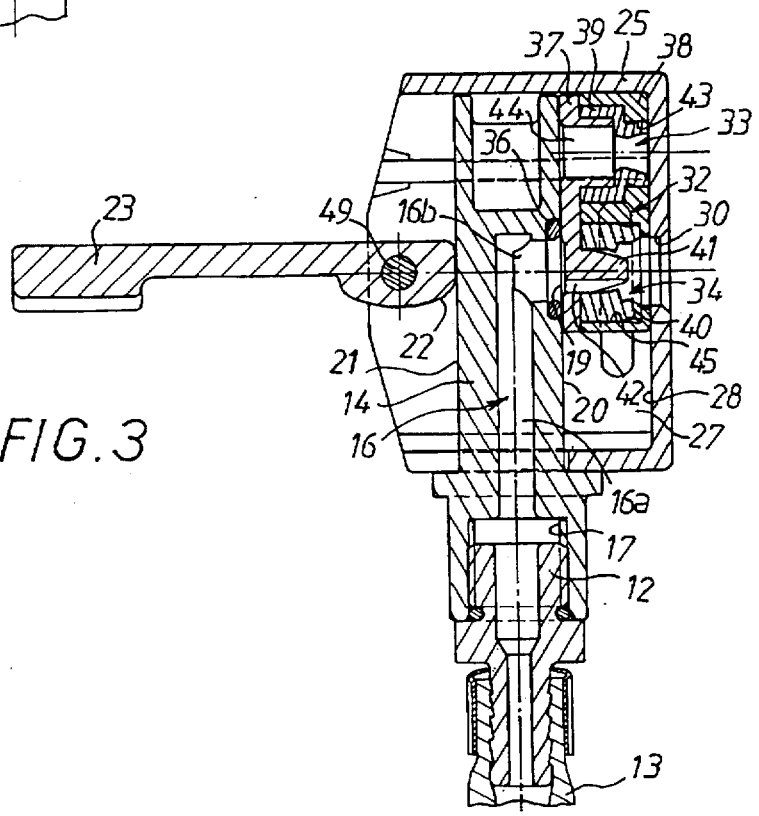
FIG. 3

FIG. 4
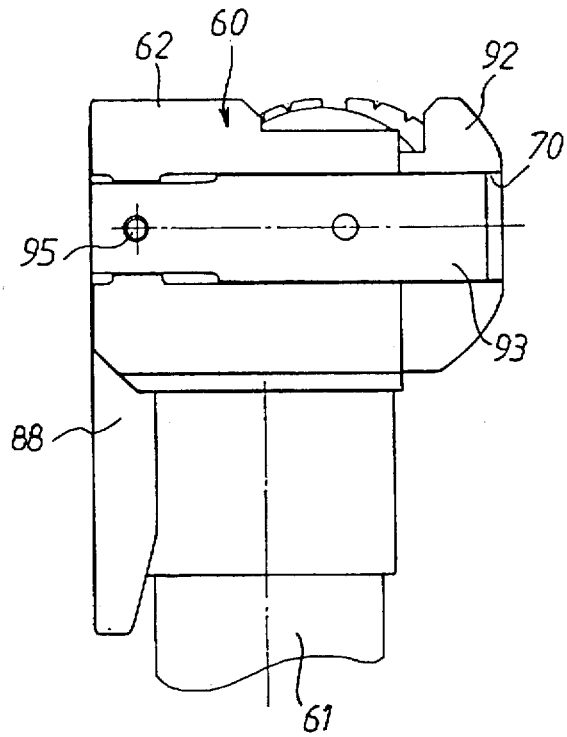
FIG. 5
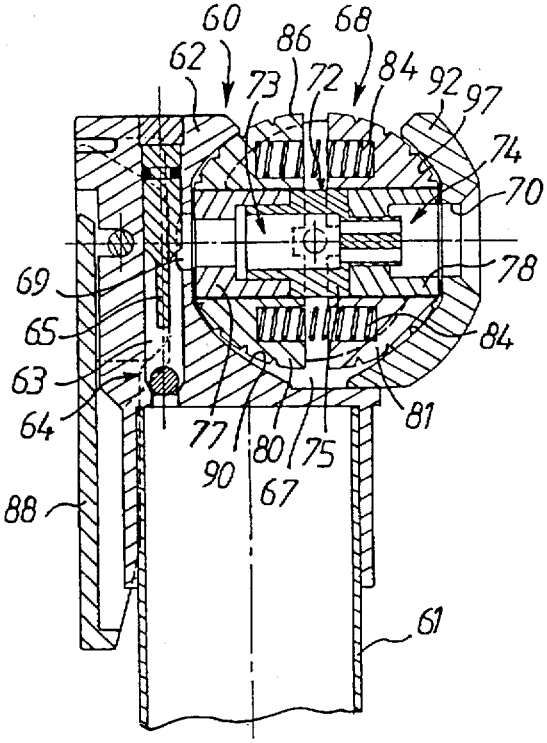
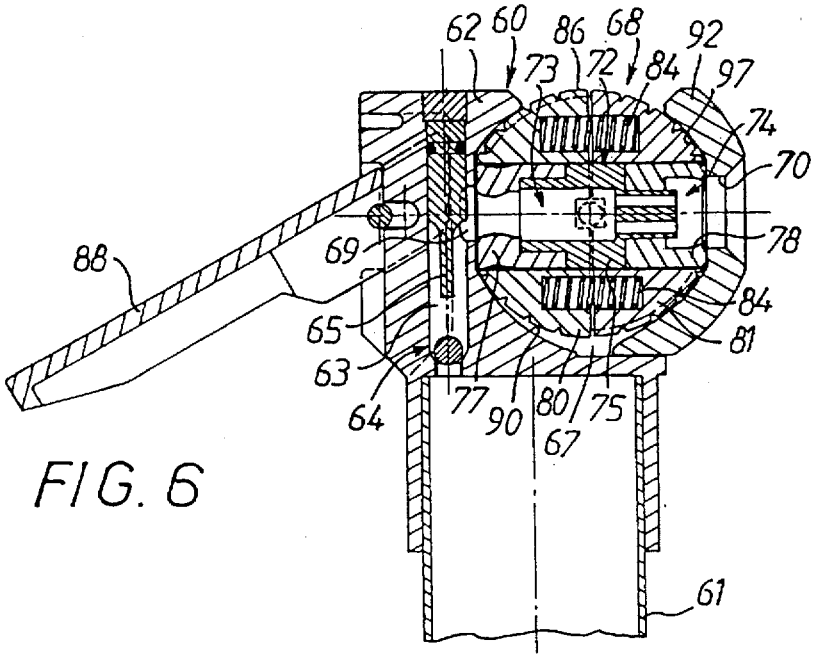
FIG. 6

PUMP CONNECTOR DEVICE

BACKGROUND OF THE INVENTION

1. Field of the Invention

The invention concerns a pump connector device for inflating a pneumatic tire. It concerns more particularly an improvement enabling use of the pump for tires from different sources incorporating valves of different types.

2. Description of the Prior Art

In the field of vehicles with two wheels, for example, it is necessary to re-inflate the tires periodically. This can be done using a manual pump or a low-power compressor.

In all cases the problem arises of connecting the source of compressed air to the valve of the tire. Depending on the source of the tire, the valve may be of one type or another. In the field of tires of two-wheel vehicles, for example, the valves most commonly used are essentially of two types known by their trade names "SCHRADER" and "PRESTA". One prior art pump has two different fixed connectors, each connector including an elastomer material sleeve adapted to surround the body of the valve with a seal between them.

However, in particular in the case of a hand pump and where the connector device is rigidly fastened to the pump body, the connector used is difficult to attach to the valve with an effective seal. Moreover, in the prior art system, the connector that is not used is neutralized by an internal closure system that is actuated pneumatically on the first stroke of the pump. This system is of high unit cost and is not totally reliable after some period of use.

A first aim of the invention is to propose a system that is simpler, more reliable and less costly for selecting the appropriate connector.

Another aim of the invention is to propose a further improved system in which the connector selected can be attached to the valve in a very firm and sealed manner.

SUMMARY OF THE INVENTION

Thus, in a first aspect, the invention concerns a pump connector device for inflating a pneumatic tire comprising an air ejector channel adapted to be connected to said pump and a mobile member containing at least two different connectors and movable in a housing between at least two predetermined positions in which one of said connectors communicates with a downstream end of said passage in a position in which it can be connected to a pneumatic tire valve.

The mobile member may be a slider moving along a straight path in a housing. In a different embodiment, the mobile member may have a rotary part inside a cavity into which said ejector passage opens.

In accordance with another advantageous feature of the invention, each connector includes an elastically deformable material sleeve adapted to be pressed against said valve and further comprising a locking mechanism cooperating with said mobile member to compress axially at least said sleeve of said connector in said position adapted to be connected to a valve, said axial compression of said connector causing it to be deformed radially inwards to grip and to be sealed to said valve.

The invention will be better understood and its other advantages will emerge more clearly from the following description of various embodiments of a pump fitted with a connector device of the invention, given by way of example only and with reference to the accompanying drawings.

BRIEF DESCRIPTION OF THE DRAWINGS

FIG. 1 is an elevation view of a connector device of the invention.

FIG. 2 is a view analogous to that of FIG. 1 showing the same device in longitudinal section.

FIG. 3 is a view analogous to FIG. 2 showing the components of the device when the locking lever is actuated.

FIG. 4 is an elevation view of the end of a pump equipped with a connector device constituting a different embodiment of the invention.

FIG. 5 is a view analogous to FIG. 4 showing the same device in longitudinal section.

FIG. 6 is a view similar to FIG. 5 showing the components of the device when the locking lever is actuated.

DETAILED DESCRIPTION OF THE PREFERRED EMBODIMENTS

Referring more particularly to FIGS. 1 to 3, a pump connector device 11 for inflating a tire of a two-wheel vehicle is shown connected by a screwthreaded connector 12 to the end of a flexible hose 13 in turn connected to a pump that cannot be seen in the drawing. The device includes a body 14 within which is defined an air ejector passage 16. The latter is formed by two perpendicular bores, a longitudinal bore **16*a* opening into the screwthreaded bore 17 into which the connector 12 is screwed and a transverse bore 16*b*. The exit orifice 19 of the passage, at the same end as the transverse bore, is defined on a first surface 20 of the body 14. An opposite and parallel second surface 21 of this body constitutes a bearing surface for a cam 22 at the end of a lever 23. The body 14 is covered by a cap 25 defining with said first surface 20 an elongate housing 27 having on a face 28 parallel to said first surface 20 an orifice 30 for insertion of the valve. A mobile member 32 is movable in the housing 27 between at least two predetermined positions. This mobile member, here constituting a sort of slider of generally rectangular parallelepiped shape, contains at least two different connectors 33, 34**.

Of course, the number of predetermined positions is equal to the number of different connectors. For each predetermined position one of the connectors is axially inserted between the exit orifice 19 of the passage and the orifice 30 into which the valve is inserted.

An annular seal 36 is provided around the opening of the passage; it comes into contact with one face of the mobile member forming the slider. The two connectors are parallel to each other within the slider. To be more precise, the latter is constituted by the assembly of two parts 37, 38 nesting one inside the other with two elastomer material sleeves 39, 40 between them. Thus the part 37 in contact with said first surface 20 of the body 14 includes a first cylindrical tubular passage 44 and a second passage 42 parallel to the first and containing an axial insert 41. The part 38 in contact with the interior wall of the cap 25 includes a first cylindrical tubular passage 43 having an internal shoulder and axially aligned with the first passage 44 and a second cylindrical tubular passage 45 having an internal shoulder and axially aligned with the second passage 42. The elastically deformable material sleeve 39, having an internal shoulder and an external shoulder, is disposed between said first passages of the parts 37 and 38. The other cylindrical tubular elastically deformable material sleeve 40, of the same kind, having an internal shoulder, is disposed between said second passages of the parts 37 and 38. In fact, the arrangement just described reconstitutes within a slider structure two different, standardized connectors 33 and 34 well known in themselves. The two connectors are parallel to each other and the mobile member 32 in the form of a slider can move along a straight path in the housing 27 between the two orifices. Each connector 33, 34 is therefore ready for use when the slider is in a corresponding predetermined position in its housing.

In this position the elastically deformable material sleeve 39 or 40 is pressed against the body of the valve that is inserted into the orifice, providing a seal all around it.

To improve this connection, the device further comprises a locking mechanism cooperating with the mobile member 32 to compress in the axial direction at least the sleeve of the connector 33 or 34 in position for connection to said valve. This axial compression of the connector causes it to be deformed radially inwards, so that said valve can be firmly gripped to make a perfectly sealed connection. To achieve this, the two parts 37, 38 are not in abutment when at rest, but can be moved relative to each other by a force tending to compress the sleeves 39, 40 in the axial direction. Actuation of the locking mechanism also compresses the seal 36, providing a perfect seal at the interface between the body 14 and the slider.

The locking mechanism includes the lever 23 mentioned above, carrying the cam 22, and this assembly is adapted to cause relative movement between at least a part of the mobile member 32 and the body 14 containing the air ejector passage. To this end the cap 25 is slidable along the body 14 and the lever 23 is articulated to said cap 25 by a pin 49.

The cap also includes a straight slot 50 parallel to the direction of movement of the mobile member 32 and the latter has a lateral operating finger 52 passing through said slot. The slider can be maneuvered by means of this finger when the lever 23 occupies the position shown in FIG. 2. In this way the appropriate connector may be selected.

When the lever occupies the position shown in FIG. 3, the mobile member 32 forming the slider is compressed in its housing because of the movement of the cap 25 relative to the body 14. The two parts constituting the slider move towards each other, which deforms the elastically deformable sleeves 39, 40, as shown in FIG. 3. In particular, the deformation of the sleeve 40 of the connector 34 in the "use" position causes it to firmly grip and seal a valve (not shown) inserted in the orifice 30.

FIGS. 4 to 6 show a different embodiment of a connector device 60 mounted directly at the end of a pump cylinder 61. The pump outlet is extended by a body 62 containing the air ejector passage 63 in which a ball check valve 64 is fitted. The travel of the ball is limited by an abutment 65 extending axially in said passage.

In this embodiment, the mobile member 68 previously mentioned has a rotary part inside a cavity 67 into which the ejector passage opens. Note that the outlet orifice 69 of the air ejector passage is coaxial with the orifice 70 for inserting the valve. The rotary part includes a transverse conduit 72 incorporating two different connectors 73, 74 analogous to those shown in FIGS. 2 and 3. These two connectors are axially aligned and face in opposite directions. They therefore extend globally between the outlet orifice 69 of the passage and the orifice 70 for inserting the valve. The conduit has a central part 75 having a cylindrical tubular passage on one side and a passage provided with an axial insert on the other side and two elastically deformable material sleeves 77, 78 analogous to the sleeves of the previous embodiment and extending axially on either side of the part 75.

The conduit 72 defined above constitutes a guide for two globally semi-cylindrical members 80, 81 sliding on the outside of the transverse conduit and urged apart by springs 84 between them. The semi-cylindrical exterior surface of each member 80, 81 includes ribs 86 or some other equivalent configuration.

The combination of the conduit 72 and the two semi-cylindrical members 80, 81 is mounted between two clamping parts adapted to be moved towards each other by a lever 88 carrying a cam in contact with the body 62, compressing the assembly in the axial direction defined by the two orifices 69, 70.

To be more precise, one of the clamping members is the body 62 housing the air ejector passage 63 and having a concave surface 90 housing part of the assembly comprising the conduit 72 and the two semi-cylindrical members 80, 81. The other clamping part 92 has two arms 93 sliding in two corresponding grooves of the body 62. The lever 88 is articulated by a pin 95 between the two ends of these arms. The orifice 70 for insertion of the valve is in the second clamping part 92 which also has a concave surface 97 surrounding a part of said assembly comprising the conduit and the two semi-cylindrical members.

In the position shown in FIG. 5 the aforementioned assembly 72, 80, 81 may be rotated in its housing defined between the two clamping parts 62, 92 to move one or other of the two connectors 73 or 74 into the service position. When a connector is in the service position, the elastically deformable material sleeve of the other connector is in a position that provides a seal between the orifice 69 of the passage 63 and said conduit 72. Operating the lever moves the two clamping parts towards each other and brings about the required deformation of the two elastically deformable material sleeves 77, 78.

There is claimed:

1. A pump connector device for inflating a pneumatic tire comprising an air ejector passage adapted to be connected to a pump and a mobile member containing at least two different connectors and movable in a housing between at least two predetermined positions in which one of said connectors communicates with a downstream end of said passage in a position in which it can be connected to a pneumatic tire valve, said mobile member comprising a slider movable along a straight path in a housing, and said ejector passage opening into said housing to communicate with one of said connectors when said slider is in a corresponding predetermined position.

2. The connector device claimed in claim 1 wherein each connector includes an elastically deformable material sleeve adapted to be pressed against said valve and further comprising a locking mechanism cooperating with said mobile member to compress axially at least said sleeve of said connector in said position adapted to be connected to a valve, said axial compression of said connector causing it to be deformed radially inwards to grip and to be sealed to said valve.

3. The connector device claimed in claim 2 wherein said locking mechanism includes a lever carrying a cam adapted to bring about relative displacement between at least one part of said mobile member and another member containing said air ejector passage.

4. The connector device claimed in claim 3 wherein an annular seal is provided around an orifice of said passage defined in said other member, said seal being compressed by actuation of said lever.

5. The connector device claimed in claim 3 wherein said passage is defined in a body having two opposite surfaces, an outlet orifice of said passage being defined on a first surface and said cam on said lever being in contact with the second surface, and said housing accommodating said mobile member is defined between said first surface and a cap sliding along said body, said lever being articulated to said cap.

6. The connector device claimed in claim 5 wherein said mobile member includes a lateral operating finger passing through a slot in said cap.

7. A pump connector device for inflating a pneumatic tire comprising an air ejector passage adapted to be connected to a pump and a mobile member containing at least two different connectors and movable in a housing between at least two predetermined positions in which one of said connectors communicates with a downstream end of said passage in a position in which it can be connected to a pneumatic tire valve wherein said mobile member has a rotary part inside a cavity into which said ejector passage opens, said rotary part including a transverse conduit incorporating two different connectors axially aligned with each other and facing in opposite directions, and said conduit being inserted between two globally semi-cylindrical members sliding on the outside of said transverse conduit and urged apart by springs between them, and a semi-cylindrical exterior surface of each member including ribs or some other operating configuration.

8. The connector device claimed in claim 7 wherein each connector includes an elastically deformable material sleeve adapted to be pressed against said valve and further comprising a locking mechanism cooperating with said mobile member to compress axially at least said sleeve of said connector in said position adapted to be connected to a valve, said axial compression of said connector causing it to be deformed radially inwards to grip and to be sealed to said valve.

9. The connector device claimed in claim 7 wherein said assembly comprising said conduit and said two members is mounted between two clamping parts adapted to be moved towards each other by said lever, compressing said assembly in a predetermined direction.

* * * * *